US005551681A

United States Patent [19]

Ferrara

[11] Patent Number: 5,551,681

[45] Date of Patent: Sep. 3, 1996

[54] DISK COMPILER INTEGRATED INTO A DISK STACKER OR DISK-IN-DISK FINISHER

[75] Inventor: Joseph J. Ferrara, Webster, N.Y.

[73] Assignee: Xerox Corporation, Stamford, Conn.

[21] Appl. No.: 435,942

[22] Filed: May 5, 1995

[51] Int. Cl.[6] ..... B42B 5/00

[52] U.S. Cl. ..... 270/58.08; 270/58.01

[58] Field of Search ..... 270/53, 58

[56] References Cited

U.S. PATENT DOCUMENTS

| | | | |
|---|---|---|---|
| 2,709,808 | 6/1955 | Murrell et al. | 270/53 X |
| 4,431,177 | 2/1984 | Beery et al. | 271/186 |
| 4,925,173 | 5/1990 | Lindblom et al. | 270/59 X |
| 5,065,996 | 11/1991 | McGraw et al. | 271/176 |
| 5,201,517 | 4/1993 | Stemmle | 270/53 X |
| 5,261,655 | 11/1993 | Keller et al. | 271/187 |
| 5,303,017 | 4/1994 | Smith . | |
| 5,409,201 | 4/1995 | Kramer | 270/53 |
| 5,409,202 | 4/1995 | Naramore et al. | 270/53 |

*Primary Examiner*—John E. Ryznic

[57] ABSTRACT

A job set compiler for compiling the printed sheets output of a printer or copier into superposed stacks of the printed sheets, inverted. The printed sheets are sequentially individually fed into a first sheet retaining unit, which rotates to move the sheet into a second sheet retaining unit neatly compiling a plurality of the sheets therein in an arcuate configuration as a complied set. The second sheet retaining unit then rotates to eject the compiled set of plural sheets. The first sheet retaining unit is concentrically rotatably mounted inside of the second sheet retaining unit. A stapling system may be provided for stapling the compiled sets while they are so held in the second sheet retaining unit.

9 Claims, 8 Drawing Sheets

DISK COMPILER INTEGRATED INTO A DISK STACKER OR DISK-IN-DISK FINISHER

Disclosed is an improved compiler for sets of plural printed copy sheets, providing a compact output compiler for a copier or printer, which may further compatibly include a stapler or other set binder finishing system for the compiled sets, and which further provides for compact inversion of the sequentially outputted copy sheets prior to stacking the copy sheets as compiled sets, or, alternatively, conventionally providing inversion and stacking of individual sheets sequentially.

In the example disclosed below, this may be accomplished by a dual rotary "disk-type" sheet handling system, with one disk system rotatable internally of the other, wherein the outputted sheets to be compiled may be individually fed into an arcuate inner disk retaining system in which they are least partially inverted, and then moved to a concentrically partially surrounding outer bail or disk system providing a compiler area. This is repeated as each sheet enters the system until a set of plural compiled sheets has been accumulated in the outer disk area, wherein the set of sheets may be stapled if desired. Then by further rotation of the outer disk system, the set is stacked, inverted, on a suitable stacking tray, which may be of the elevator type.

The transporting and compiling of copy sheets while they are corrugated or arcuately deformed provides significant advantages in effective stiffness, called beam strength, as is known in the art in other applications. The disclosed system provides for substantial such desirable curvature of both the entering sheet and the sheets being compiled. This is particularly desired for thin, lightweight, flimsy paper sheets. Yet the disclosed system provides a sufficiently large radius at all times so as not to provide sheet feeding interference, or curling, of heavy or stiff copy sheets.

As is well known in the art, copy sheet compiling is typically done in substantially flat (planar) trays or bins. Also, typically in compilers, the incoming top sheet is driven into registration to form a squared stack aligned on two orthogonal axes, known as corner registration, by a rubber flapper, jogger wheels, or the like. These have disadvantages in terms of wear and possible smearing of freshly inked or otherwise printed images on the surface of the sheet so engaged. Some examples of set compilers and staplers of this type are disclosed in Xerox Corporation U.S. Pat. No. 5,342,034 issued Aug. 30, 1994 to B. Mandel et al; and U.S. Pat. No. 5,303,017 issued Apr. 12, 1994 to Richard S. Smith. The latter patent is of particular interest for its FIG. 8 and the description thereof in Col. 2, middle, further described in Col. 10, the penultimate paragraph of said U.S. Pat. No. 5,303,017. However, as noted therein, this is only a two sheet overlapping delay system, not a copy sheet set compiler. A similar disclosure is in Xerox Corporation U.S. Pat. No. 5,289,251 issued Feb. 22, 1994 to B. Mandel et al.

Further by way of background, conventional disk stackers for the output of copiers or printers only invert one single sheet at a time. See, e.g., Xerox Corporation U.S. Pat. No. 4,431,177 issued Feb. 14, 1984 to J. Berry et al; U.S. Pat. No. 5,065,996 issued Nov. 19, 1991 to T. McGraw et al; U.S. Pat. No. 5,261,655 issued Nov. 16, 1993 to P. Keller et al; and U.S. Pat. No. 5,409,202 issuing Apr. 25, 1995 or U.S. Pat. No. 5,409,201 issuing Apr. 25, 1995 both to Naramore and Kramer; and art cited therein.

It is increasingly important to provide more automatic handling of sheets being printed, especially collated and/or finished (fastened) sets of sheets. Yet avoidance of sheet set skewing and maintaining proper registration of document sheets is also important.

A specific feature of the specific embodiment(s) disclosed herein is to provide a job set compiler for compiling the printed sheets output of a printer or copier into superposed stacks of said printed sheets, into which job set compiler said printed sheets are sequentially individually fed, comprising: a first sheet retaining unit for sequentially receiving therein a single said sequentially individually fed sheet and temporarily retaining said sheet therein; a second and adjacent sheet retaining unit for sequentially receiving from said first sheet retaining unit a plurality of said sheets and compiling said plurality of sheets therein in an arcuate configuration as a complied set, said second sheet retaining unit being rotatable to eject said compiled set of plural sheets retained as a compiled set.

Further specific features provided by the system disclosed herein, individually or in combination, include those wherein said first sheet retaining unit sequentially temporarily retains therein only one said sheet at a time in an arcuate configuration, and is adapted to move said sheet into said adjacent second sheet retaining unit for said compiling therein; and/or said first sheet retaining unit is mounted inside of said second sheet retaining unit, generally concentrically therewith; and/or said first sheet retaining unit is rotatably mounted inside of said second sheet retaining unit so as to eject said single sheet from said first sheet retaining unit into said second sheet retaining unit upon rotation of said first sheet retaining unit; and/or a stapling system is provided for stapling said compiled sets while they are in said second sheet retaining unit; and/or said first sheet retaining unit is sequentially rotated once to move each sheet from said first sheet retaining unit into said second sheet retaining unit while said second sheet retaining unit is held stationary until said plurality of sheets is compiled therein; and/or said first sheet retaining unit is concentrically rotatably mounted inside of said second arcuate sheet retaining unit, wherein said first sheet retaining unit sequentially temporarily receives therein one said sheet at a time in an arcuate configuration, and then moves said sheet out into said second sheet retaining unit while retaining said arcuate configuration thereof by rotation of said first sheet retaining unit within said second sheet retaining unit, and wherein said second sheet retaining unit is held stationary until said plurality of sheets is compiled therein, and is then rotatable to eject the set of sheets compiled therein; and/or said first and second sheet retaining units also provide inversion of said printed sheets as so ejected as said compiled set; and/or including an integral tamping system, and a registration system, and wherein said first and second sheet retaining units hold and support said sheets in an arcuate configuration for increased sheet beam strength as each sheet is tamped and registered in said tamping and registration systems.

It is well known to program and execute paper handling control functions and logic with software instructions for conventional or general purpose microprocessors. This is taught by various prior patents and commercial products. Such programing or software may of course vary depending on the particular functions, software type, and microprocessor or other computer system utilized, but will be available to, or readily programmable without undue experimentation from, functional descriptions, such as those provided herein, or prior knowledge of functions which are conventional, together with general knowledge in the software and computer arts. That can include object oriented software development environments, such as C++. Alternatively, the disclosed system or method may be implemented partially or fully in hardware, using standard logic circuits or a single chip using VLSI designs.

As shown in the art, the control of exemplary copy sheet handling systems may be accomplished by conventionally actuating them by signals from the copier controller directly or indirectly in response to simple programmed commands and from selected actuation or non-actuation of conventional switch inputs by the operator. The resultant controller signals may conventionally actuate various conventional electrical solenoid or cam-controlled sheet deflector fingers, motors or clutches in the selected steps or sequences as programmed. Conventional sheet path sensors or switches connected to the controller may be utilized for sensing and timing the positions of copy sheets, as is well known in the art. Known copying systems utilize such conventional microprocessor control circuitry with such connecting switches and sensors for counting and comparing the numbers of copy sheets, keeping track of their general positions, counting the number of completed document set circulations and completed copies, etc. and thereby controlling the operation of the copy sheet feeders, inverters, finishers, etc..

In the description herein the term "sheet" refers to a usually flimsy physical sheet of paper, plastic, or other suitable physical substrate for images, whether precut or initially web fed. A "copy sheet" may be abbreviated as a "copy", or "hardcopy". A "job" is normally a set of related sheets, usually a collated copy set copied from a set of original document sheets or electronic document page images, from a particular user, or otherwise related. A "simplex" document or copy sheet is one having its image and page number on only one side or face of the sheet, whereas a "duplex" document or copy sheet has "pages", and normally images, on both sides.

As to specific hardware components of the subject apparatus, or alternatives therefor, it will be appreciated that, as is normally the case, some such specific hardware components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below, as well as the claims. Thus, the present invention will be better understood from this description of one embodiment thereof, including the drawing figures (approximately to scale) wherein:

FIG. 1, labeled "prior art", is a side view, partly in cross-section, of a simplified example of a prior art type disk stacker for inverting or stacking individual single printer or copier output sheets, one sheet at a time;

FIGS. 2–13 show the sequential operations of a schematic side view of one embodiment of the subject disk compiling and finishing and stacking system;

In particular, FIG. 2 illustrates the first sheet of a first set entering the exemplary unit;

Figure 13:
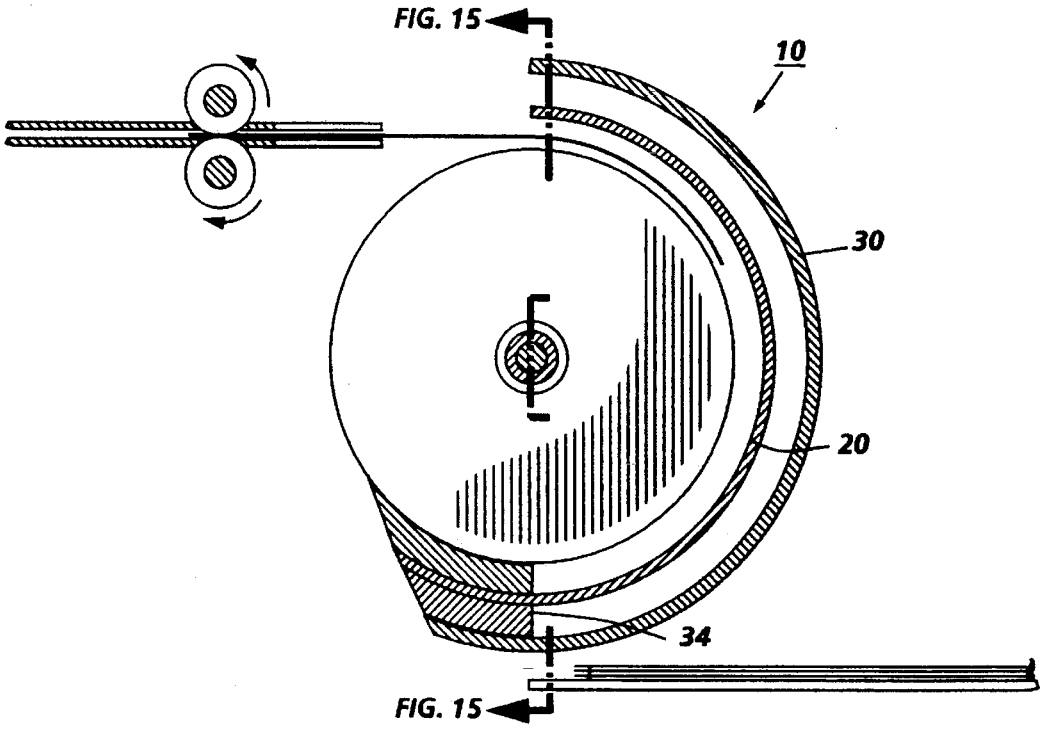
FIG. 13 shows the stacked, ejected set and the entry of the first sheet of the next set to be compiled.
Figure 14:
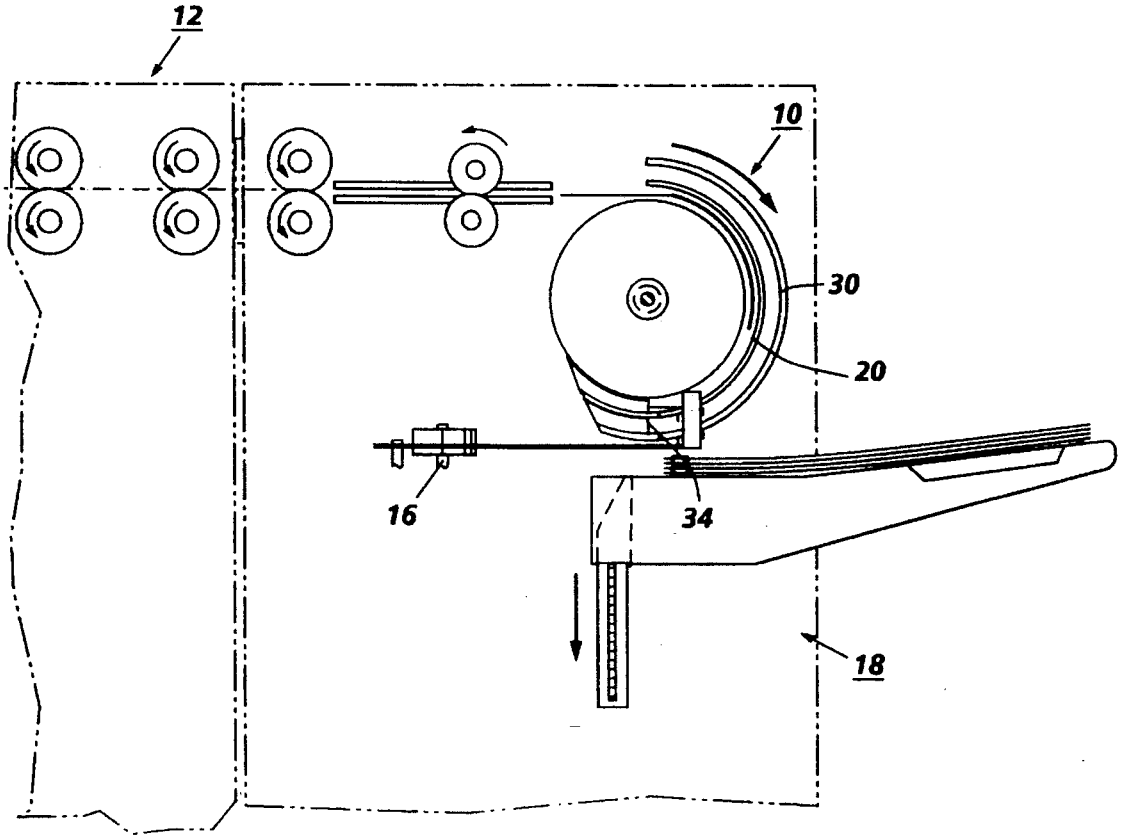
Figure 15:
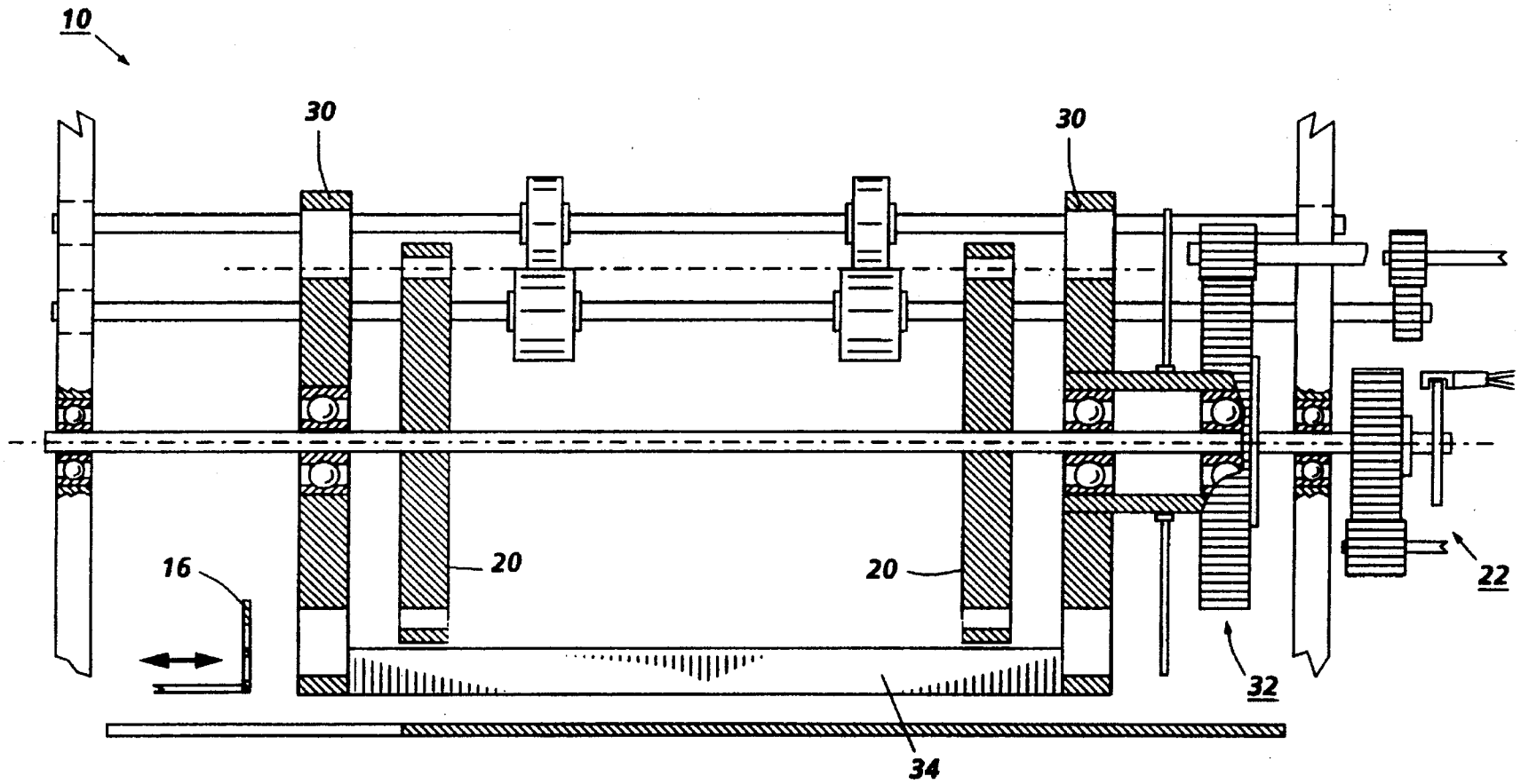

FIG. 14 illustrates the subject exemplary system of FIGS. 2 through 13 in a schematic view with an exemplary printer or copier output, with an elevator tray stacker, and also with an exemplary side edge tamper system; and FIG. 15 is an end view, partially in cross-section, of the system of FIGS. 2–13, taken along the FIG. 15 indicated line of FIG. 13, illustrating exemplary rotational mounting and drive systems for the inner and outer disk assemblies.

Describing now in further detail the system illustrated in FIGS. 1–15, it will be appreciated that this disk type compiler/stapler system 10 is merely one example of the subject invention. This system or unit 10 can be utilized with almost any copier or printer 12, so only the output thereof is schematically illustrated, in FIG. 14. Preferably, the output will be precollated so that the unit can stack fully collated sets. These may be printed "face up" and outputted as such without requiring an internal inverter, since the system in unit 10 provides inversion of the copy sheets as well as compiling, and compiles the sets in the order in which they are outputted with the first sheet down, i.e., in 1 to N order, face down, thus providing collated output of the sets.

Figure 11:
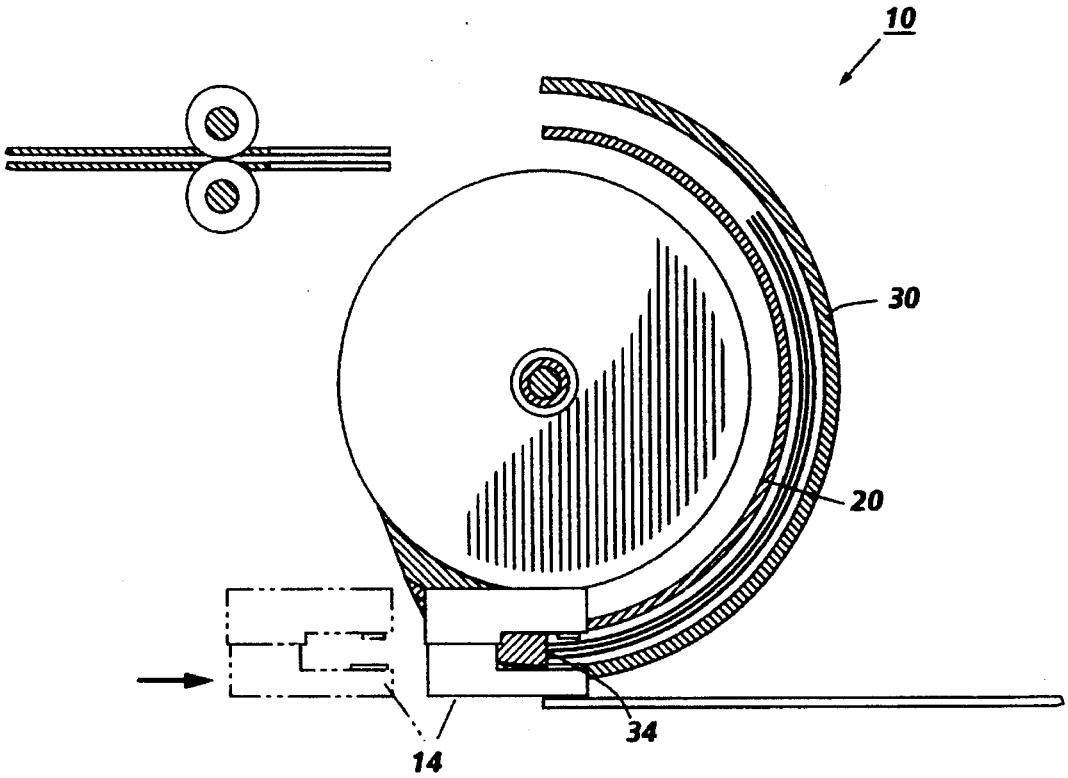
FIG. 11 shows the insertion of a stapler to staple the fully compiled (completed) set after further sheets have been compiled in the same manner as above.
Figure 12:
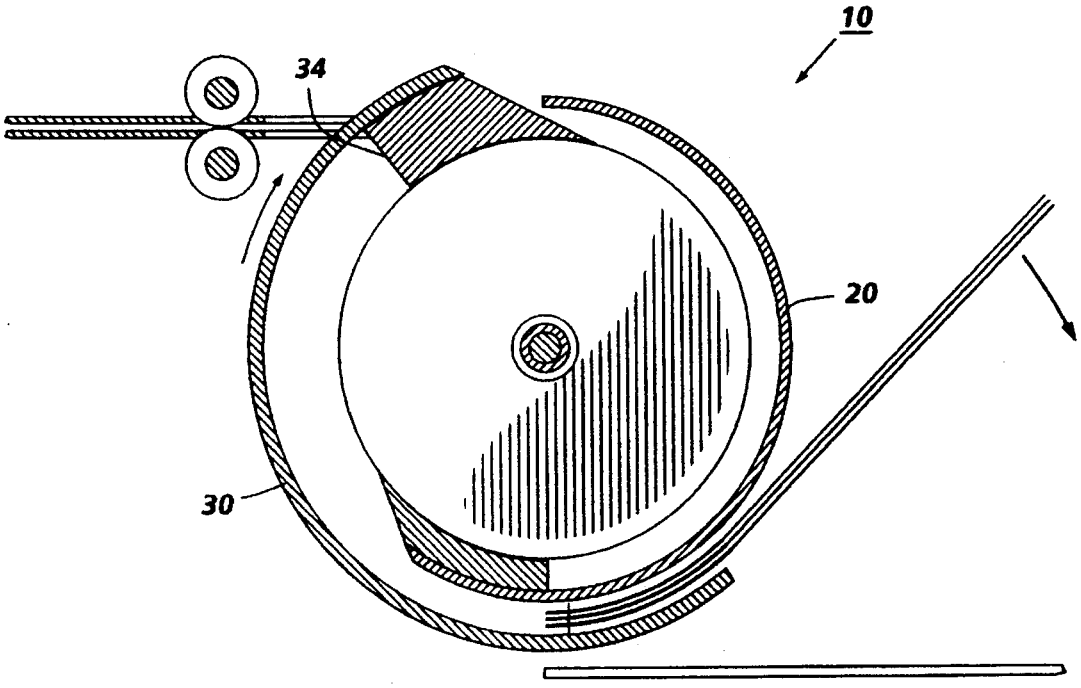
FIG. 12 shows the rotation of the outer disk assembly for the ejection of the compiled and stapled set.

Although one or more staplers 14 may be provided for set stapling, as is illustrated in FIG. 11, or in the above-cited references in different locations, it will be appreciated that this is not required and that the system 10 may also be utilized for compiling and stacking unbound sets. In either case, but particularly for unstapled sets, a sheet side tamping or jogging system such as 16, illustrated in FIGS. 14 and 15 and in the references cited above, may be provided to transversely shift each incoming sheet and/or outputted compiled set into a desired transverse edge registration position so that the stacked sets may be laterally offset from one another, yet with the sheets all squarely stacked vertically superposed within each compiled set.

Also illustrated in FIG. 14 is an example of a conventional elevator-type stacker comprising a stacking tray 18, which automatically moves down as additional compiled sets (customer jobs) are stacked on top of one another on this output tray. This is desirable with a disk stacker, as is known, so that the drop distance from the disk stacker unit may be maintained to a relatively constant and small distance.

Note that FIG. 15 is taken along the lines shown in FIG. 13. The tamper or jogging system 16 is also illustrated in FIG. 15, with associated double headed movement arrows. However, the tamper system 16 and the stapler 14 are not shown in most of the views here, so as not to obscure the view and operation of the sheet entering and compiling operations illustrated therein.

The system 10 here includes an inner disk assembly 20 and an outer disk assembly 30, with respective intermittent rotatable drives 22 and 32, respectively, shown in one example in FIG. 15. The mounting of these respective assemblies and the different independent rotational drives thereof in this example are best illustrated on FIG. 15. However, it will be appreciated that this is merely exemplary of one embodiment, and that other mounting systems and drives may be provide, achieving the same operation and function.

Describing now in further detail the system 10 per se, disclosed is a concentric disk assembly within disk assembly arrangement for receiving the incoming individual sheets in the inner disk assembly 20, and for that inner disk assembly 20 to move the sheets one at a time by each rotation by drive 22 into an overlying, slightly larger diameter, outer disk assembly 30 which provides an arcuate compiler station. That compiler station provided by the outer disk assembly 30 can provide good registration of the set for compiling and if desired, for stapling therein. After the compiling, and any stapling, is completed, this outer disk assembly 30 then is rotated once by drive 32 to deliver the completed set onto a stacking tray such as the stacker 18. The unit 30 may be held stationary while compiling.

This system 10 provides for improved registration, paper handling control and reliability, and yet is compact and mechanically fairly simple. As described above, both the incoming sheets and the sheets being compiled are maintained in a desirable arcuate continuous radius configuration for good sheet beam strength, that is, a greatly improved sheet rigidity particularly desirable for lateral registration and positive control. Furthermore, the overall unit 10 is highly compact, particularly since the inner disk assembly 20 is mounted within the radius of the outer disk assembly 30.

Figure 1:
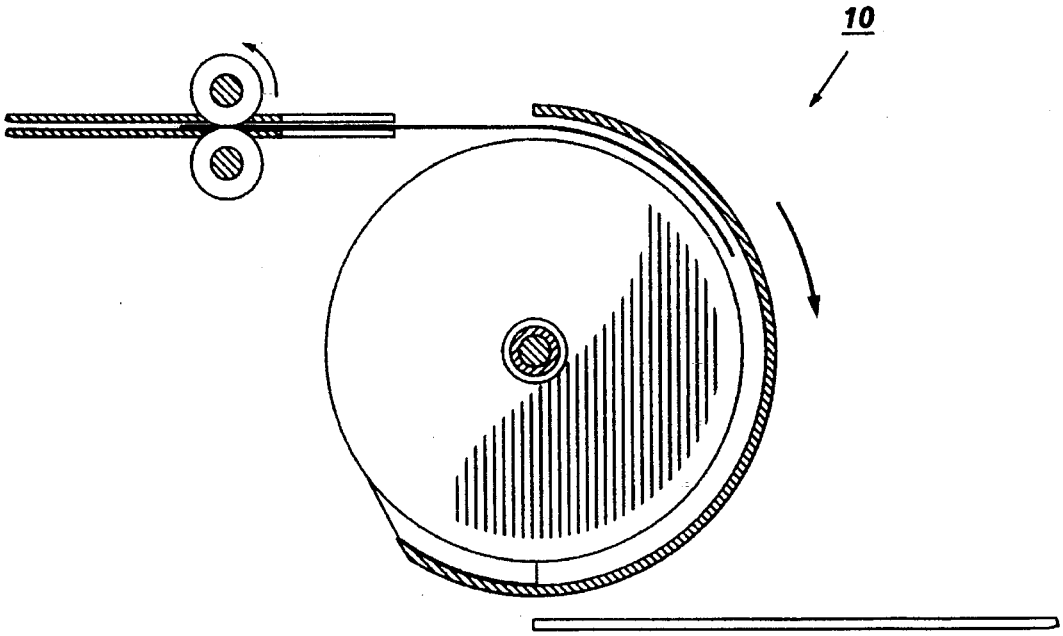
PRIOR ART FIG. 1
Figure 2:
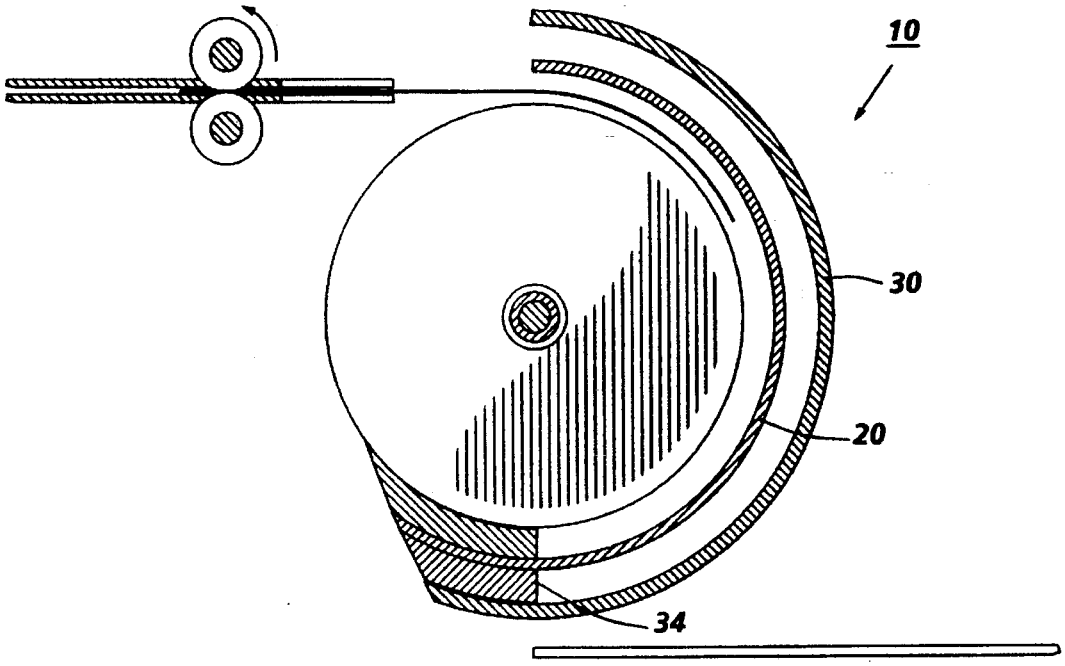
Figure 3:
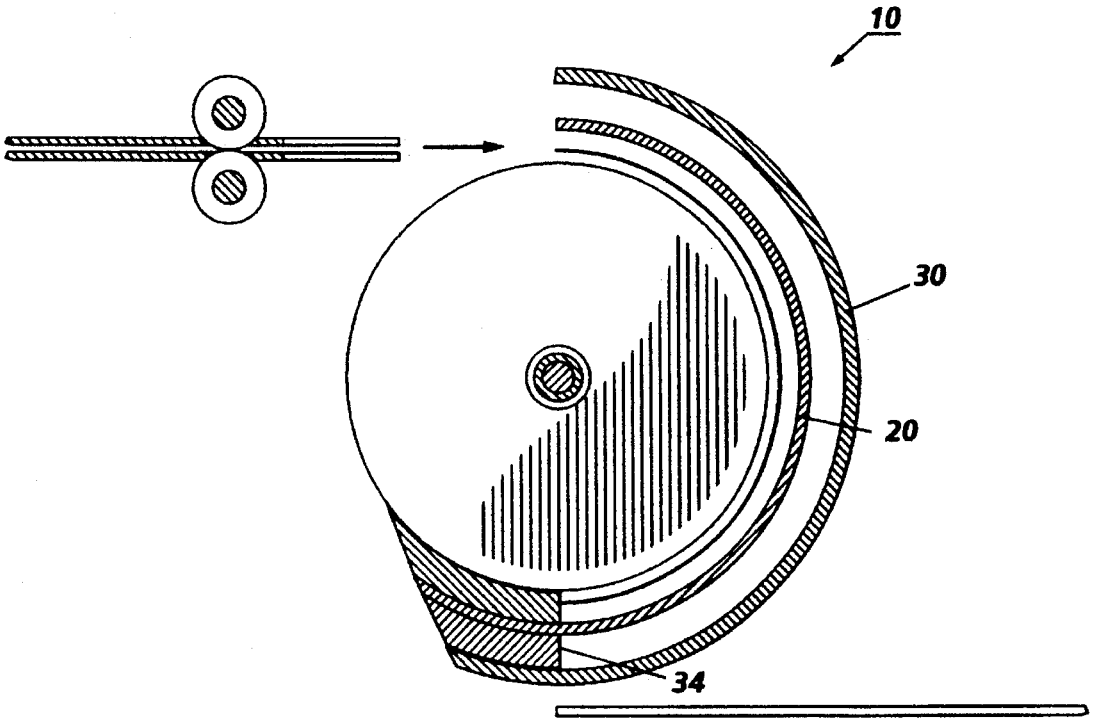
FIG. 3 shows the first sheet fully inserted into the unit.
Figure 4:
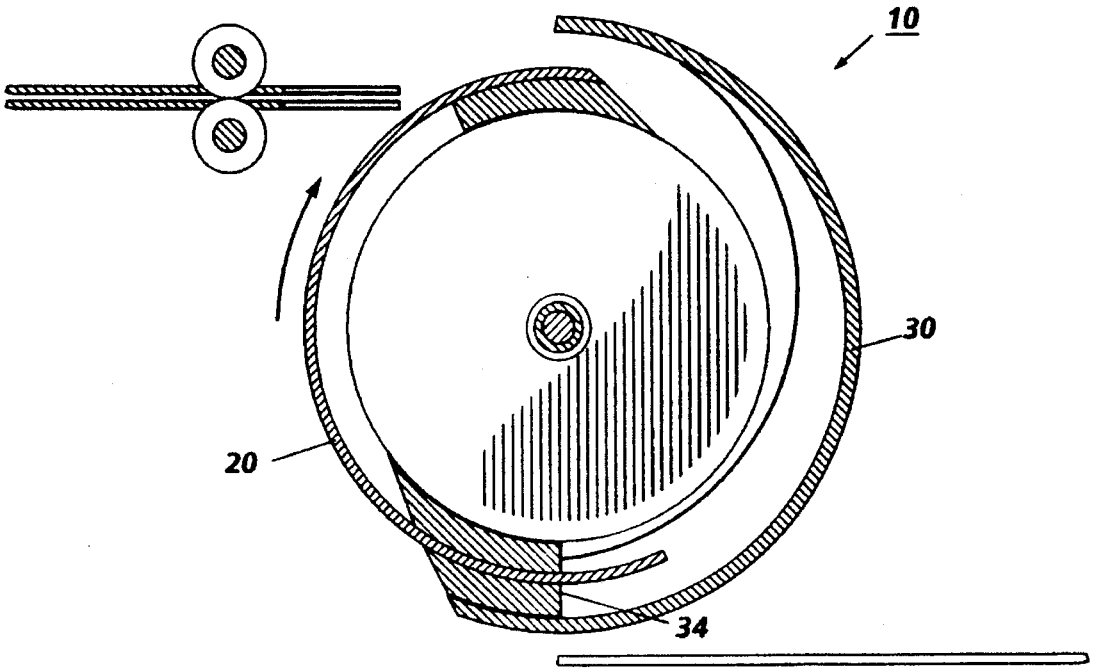
FIG. 4 shows the rotation of the inner disk assembly to release the first sheet to the concentric outer disk or bail unit.
Figure 5:
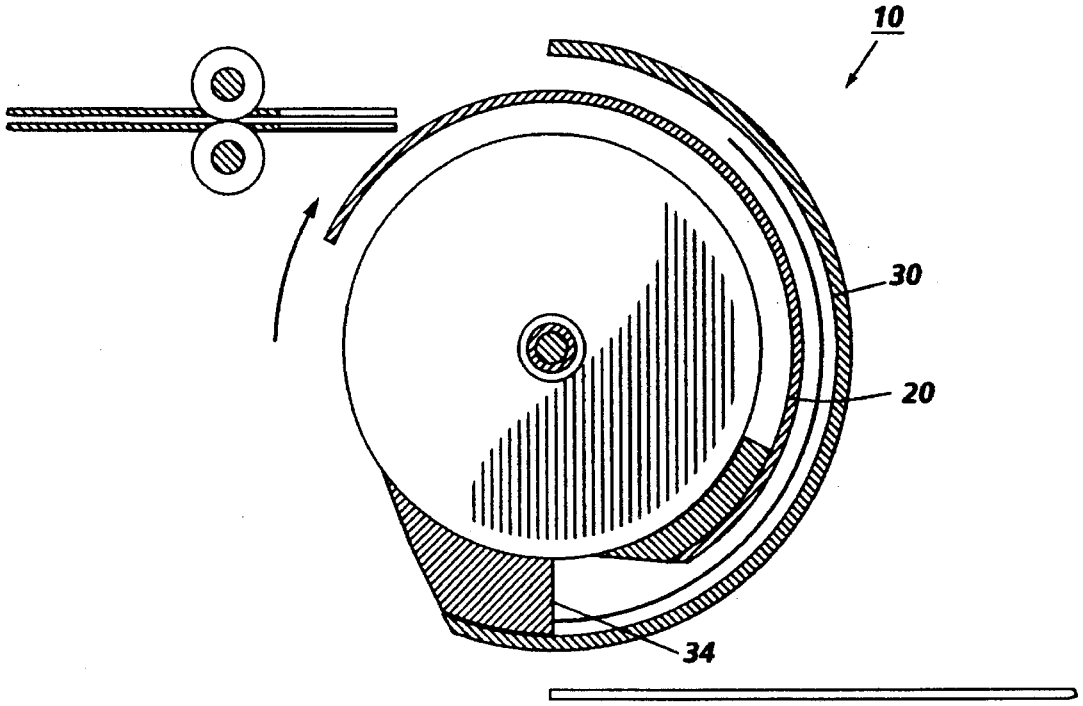
FIG. 5 shows the further rotation of the inner disk unit to compile the first sheet in the outer disk assembly.
Figure 6:
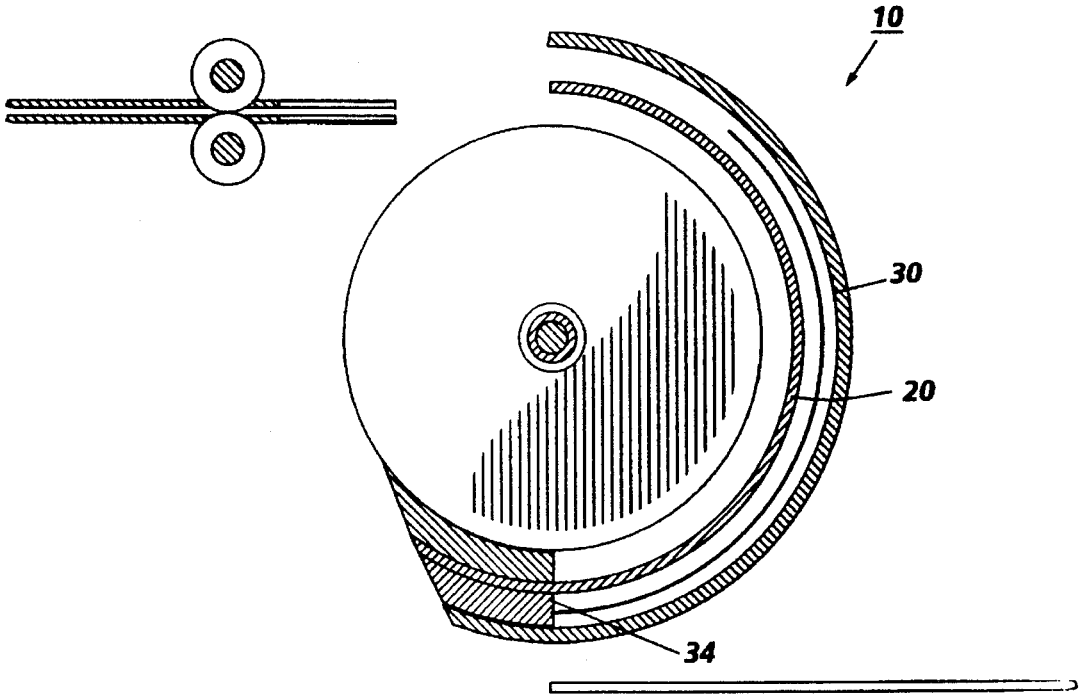
FIG. 6 shows the completion of the movement of FIG. 5 in preparation for receipt of a second sheet.
Figure 7:
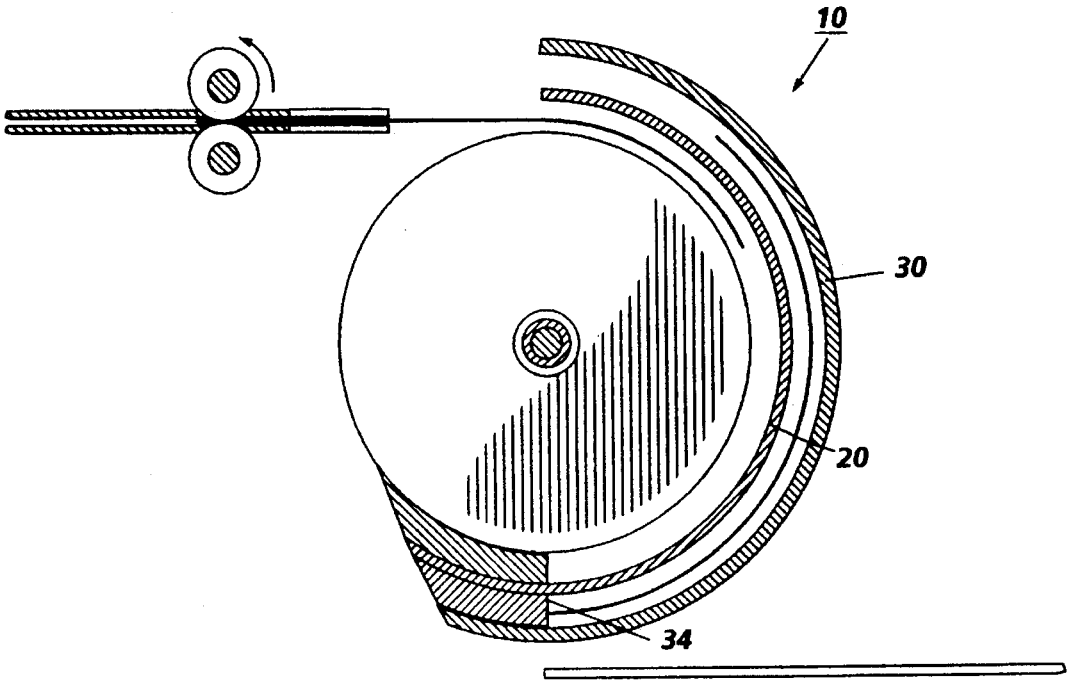
FIG. 7 shows the entrance of the second sheet into the inner disk assembly.
Figure 8:
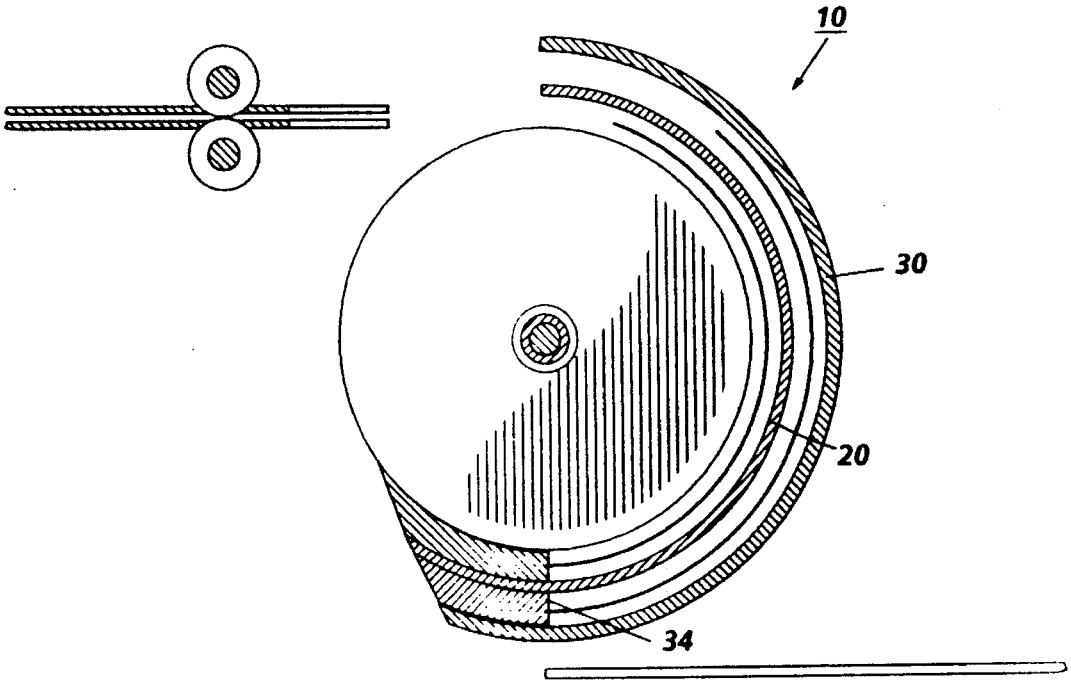
FIG. 8 shows that second sheet fully entered.
Figure 9:
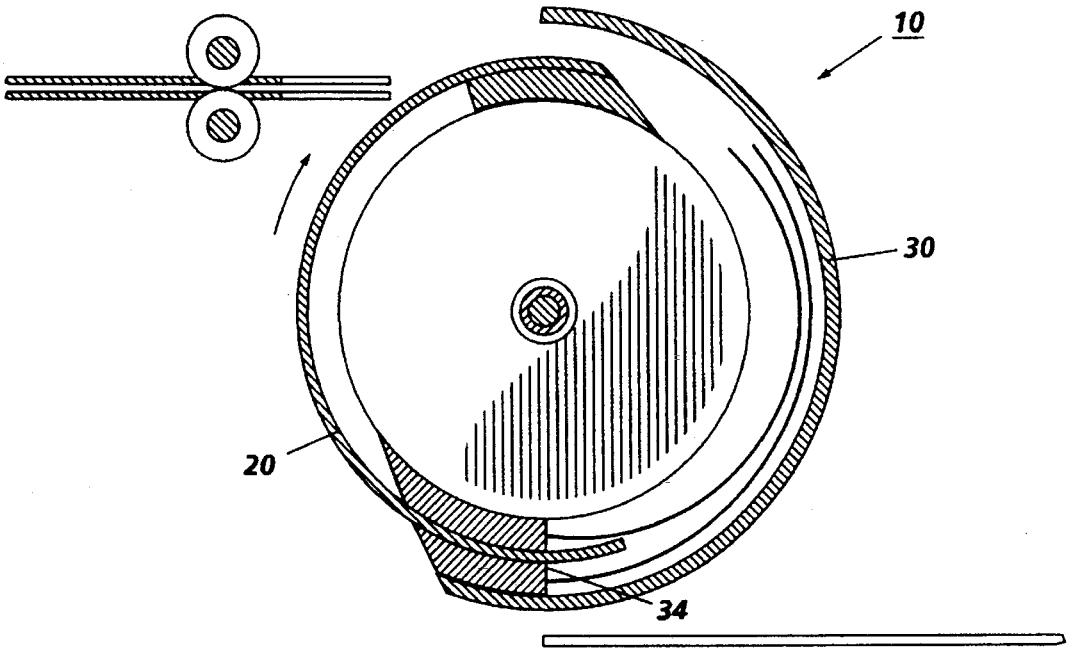
FIGS. 9 and 10 show the second rotation of the inner disk assembly to compile the second sheet in the outer disk assembly aligned and registered on top of the first sheet.

The feeding of the sheets into the slots provided by the arcuate fingers of a disk type stacker is well known in the art, and fully described in the above-cited references, and thus need not be described in detail herein. Furthermore, for comparison, FIG. 1 shown an exemplary disk stacker for single sheets labeled "prior art". It has been drawn to be similar in shape and configuration to the other figures here so as to provide for clarity of comparison between the present system and such a conventional disk stacker. That is, it is not drawn from any actual prior art apparatus, it is merely representative thereof. Such disk stackers are commonly used on a variety of printers. This technology has been utilized for several years as is shown by the cited exemplary patents. It is particularly desirable to provide compiling and stapling capabilities to such disk stacker output systems. However, there are several problems in doing so, some of which are discussed in the above-cited recent patents to Naramore and Kramer, which also provide set stapling, but not in the disk stacker unit while the sheets are arcuately controlled.

Especially for stapling, it is desired to compile sheets in a set to a registration accuracy of approximately 1.3 mm or better (less). This registration accuracy is difficult to maintain without an active in-tray registration mechanism where registration is done in a tray. I.e., prior art flappers, joggers, or the like, as cited above. In a prior art disk stacker such as in FIG. 1, while the sheet may be edge registrated while it is in the disk stacker, the registration may be lost or go out of specification when the sheet is released onto the stacking tray. Also, as discussed in the above-cited patents, process direction misregistration can also occur during the sheet release and from any bouncing or rebound from a registration edge in the tray where the prior art disk stackers are of the typical type releasing the sheet against a fixed registration edge.

In contrast, in the present system, the sheets are all compiled within the disk stacker unit 10 itself integrally the inversion operation of the disk stacker, and without losing control over or releasing the sheets or dropping them from the disk stacker unit 10. The sheets are acquired in a generally conventional disk stacker manner in the inner disk assembly 20 as individual sheets. However, then, instead of being released and dropped onto a stacking tray surface, here each sheet is moved out a very short distance into an overlying concentric outer disk assembly 30 in which they are compiled one at a time into a complete set.

Figure 10:
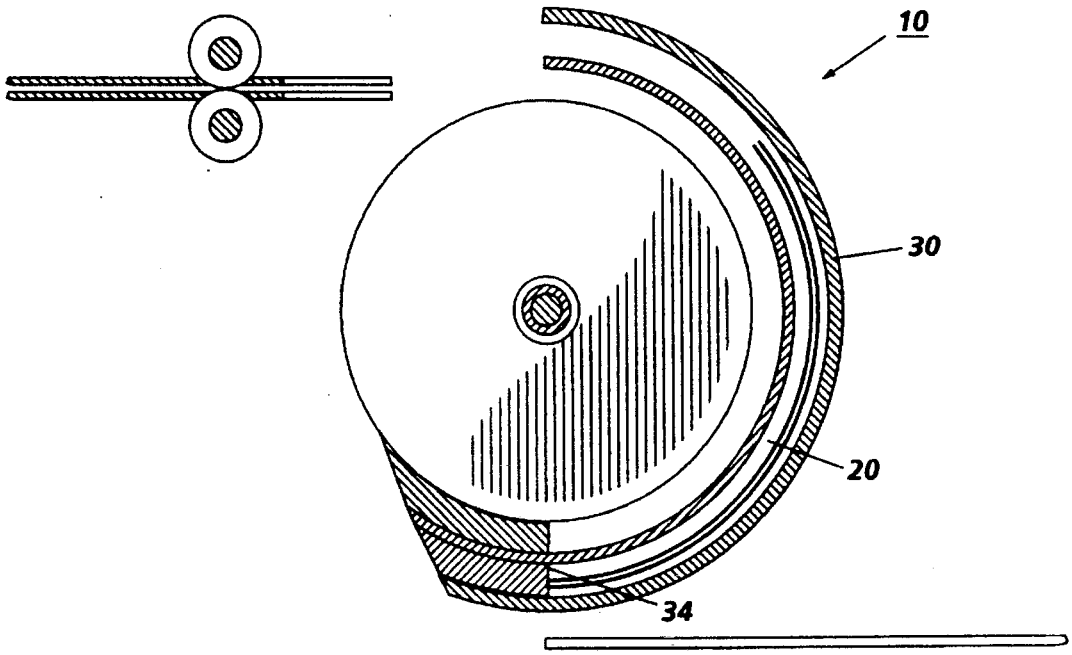

As may be seen particularly in FIGS. 10 and 11, both the rotational movement of the disk assemblies and gravity assist in maintaining positive registration of the sheets being compiled in the outer disk assembly 30. The lead edge of each sheet is compiled against a registration edge 34 at the bottom of the arcuate slot provided by the outer unit 30. This may be the same as the stop or registration edge on the chute or slots of the inner unit 20. In effect, the compiler here is the uniform radius scroll or shell spacing between the outer surface of the inner disk assembly 20 and the inner surface of the outer disk assembly 30. The respective scroll fingers thereof in effect provide baffles for guiding and holding the sheets being compiled in an arcuate channel.

In the present system, the same lateral sheet tamper 16 can be used for either or both the incoming sheet in the first unit 20 or the compiled set in the second unit 30, since they hold their sheets directly adjacent one another. In both, the sheets are held essentially cylindrically, for good stiffness and beam strength during such lateral tamping. The tamper 16 can also be used for lateral offsetting of alternate sets before outputting.

It will be appreciated from this teaching that various alternatives, modifications, variations or improvements therein may be made by those skilled in the art, which are intended to be encompassed by the following claims:

| D/94496 REFERENCE NUMBERS-PFM-3/24/95 | |
|---|---|
| disk type compiler/stapler system | 10 |
| copier or printer (FIG. 14) | 12 |
| stapler (FIG. 11) | 14 |
| side tamper (jogging) system (FIGS. 14 and 15) | 16 |
| elevator stacker (FIG. 14) | 18 |
| inner disk assembly | 20 |
| drive (FIG. 15) | 22 |
| outer disk assembly | 30 |
| drive (FIG. 15) | 32 |
| registration edge (for lead edges of stacks) | 34 |

What is claimed is:

1. A job set compiler for compiling the printed sheets output of a printer or copier into superposed stacks of said printed sheets, into which job set compiler said printed sheets are sequentially individually fed, comprising:

a first sheet retaining unit for sequentially receiving therein a single said sequentially individually fed sheet and temporarily retaining said sheet therein;

a second and adjacent sheet retaining unit for sequentially receiving from said first sheet retaining unit a plurality of said sheets and compiling said plurality of sheets therein in an arcuate configuration as a complied set, said second sheet retaining unit being rotatable to eject said compiled set of plural sheets retained as a compiled set.

2. The job set compiler of claim 1, wherein said first sheet retaining unit sequentially temporarily retains therein only one said sheet at a time in an arcuate configuration, and is adapted to move said sheet into said adjacent second sheet retaining unit for said compiling therein.

3. The job set compiler of claim 1, wherein said first sheet retaining unit is mounted inside of said second sheet retaining unit, generally concentrically therewith.

4. The job set compiler of claim 1, wherein said first sheet retaining unit is rotatably mounted inside of said second sheet retaining unit so as to eject said single sheet from said first sheet retaining unit into said second sheet retaining unit upon rotation of said first sheet retaining unit.

5. The job set compiler of claim 1, wherein a stapling system is provided for stapling said compiled sets while they are in said second sheet retaining unit.

6. The job set compiler of claim 1, wherein said first sheet retaining unit is sequentially rotated once to move each sheet from said first sheet retaining unit into said second sheet retaining unit while said second sheet retaining unit is held stationary until said plurality of sheets is compiled therein.

7. The job set compiler of claim 1, wherein said first sheet retaining unit is concentrically rotatably mounted inside of said second arcuate sheet retaining unit, wherein said first sheet retaining unit sequentially temporarily receives therein one said sheet at a time in an arcuate configuration, and then moves said sheet out into said second sheet retaining unit while retaining said arcuate configuration thereof by rotation of said first sheet retaining unit within said second sheet retaining unit, and wherein said second sheet retaining unit is held stationary until said plurality of sheets is compiled therein, and is then rotatable to eject the set of sheets compiled therein.

8. The job set compiler of claim 1, wherein said first and second sheet retaining units also provide inversion of said printed sheets as so ejected as said compiled set.

9. The job set compiler of claim 1, including an integral tamping system and registration system, and wherein said first and second sheet retaining units hold and support said sheets in an arcuate configuration for increased sheet beam strength as each sheet is tamped and registered in said tamping and registration systems.

* * * * *